US011092340B2

(12) United States Patent
Matsuyama et al.

(10) Patent No.: US 11,092,340 B2
(45) Date of Patent: Aug. 17, 2021

(54) FUEL INJECTION DEVICE

(71) Applicant: KAWASAKI JUKOGYO KABUSHIKI KAISHA, Hyogo (JP)

(72) Inventors: Ryusuke Matsuyama, Osaka (JP); Takeo Oda, Kobe (JP); Hitoshi Fujiwara, Nerima-ku (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 247 days.

(21) Appl. No.: 16/064,599

(22) PCT Filed: Dec. 22, 2016

(86) PCT No.: PCT/JP2016/088413
§ 371 (c)(1),
(2) Date: Jun. 21, 2018

(87) PCT Pub. No.: WO2017/111041
PCT Pub. Date: Jun. 29, 2017

(65) Prior Publication Data

US 2018/0372319 A1 Dec. 27, 2018

(30) Foreign Application Priority Data

Dec. 22, 2015 (JP) ..... JP2015-249699

(51) Int. Cl.
*F23R 3/14* (2006.01)
*F23R 3/28* (2006.01)
(Continued)

(52) U.S. Cl.
CPC ..... *F23R 3/286* (2013.01); *F23D 11/107* (2013.01); *F23R 3/14* (2013.01); *F23R 3/343* (2013.01); *F23R 2900/03343* (2013.01)

(58) Field of Classification Search
CPC ..... F23R 3/10
See application file for complete search history.

(56) References Cited

U.S. PATENT DOCUMENTS 5,930,999 A * 8/1999 Howell ..... F23D 11/107 239/402
6,357,237 B1 * 3/2002 Candy ..... F23D 11/36 60/737
(Continued)

FOREIGN PATENT DOCUMENTS

FR 2958015 A1 * 9/2011 ..... F23D 11/105
JP 2008-190855 A 8/2008
(Continued)

OTHER PUBLICATIONS

Matsuyama, Ryusuke, et al. "Development of a lean staged combustor for small aero-engines." Turbo Expo: Power for Land, Sea, and Air. vol. 44687. American Society of Mechanical Engineers, 2012. (Year: 2012).*
(Continued)

*Primary Examiner* — Gerald L Sung
*Assistant Examiner* — Marc J Amar
(74) *Attorney, Agent, or Firm* — Sughrue Mion, PLLC

(57) ABSTRACT

A main fuel injector of a fuel injection device includes: a main outer air passage including an inlet that is open outward in a radial direction, the main outer air passage taking in compressed air through the inlet; a main inner air passage including an inlet that is open inward in the radial direction, the main inner air passage taking in the compressed air through the inlet; a merged air passage, in which the compressed air taken in by the main outer air passage and the compressed air taken in by the main inner air passage merge together; and a main fuel injection port configured to inject a fuel into the compressed air taken in by the main outer air passage or into the compressed air taken in by the main inner air passage.

10 Claims, 4 Drawing Sheets

(51) Int. Cl.
*F23D 11/10* (2006.01)
*F23R 3/34* (2006.01)

(56) References Cited

U.S. PATENT DOCUMENTS

| | | | | |
|---|---|---|---|---|
| 6,418,726 | B1 | 7/2002 | Foust et al. | |
| 7,926,744 | B2 * | 4/2011 | Thomson | F23R 3/28 239/405 |
| 2005/0127537 | A1 * | 6/2005 | Oda | F23R 3/286 261/78.1 |
| 2005/0130089 | A1 * | 6/2005 | Oda | F23R 3/286 431/183 |
| 2006/0277921 | A1 * | 12/2006 | Patel | F23R 3/54 60/804 |
| 2010/0251719 | A1 | 10/2010 | Mancini et al. | |
| 2012/0305673 | A1 * | 12/2012 | Matsuyama | F23R 3/343 239/533.2 |
| 2013/0327849 | A1 * | 12/2013 | Matsuyama | F23R 3/286 239/406 |

FOREIGN PATENT DOCUMENTS

| | | | |
|---|---|---|---|
| JP | 4162430 | B2 | 10/2008 |
| JP | 2012-251742 | A | 12/2012 |
| JP | 2013-253738 | A | 12/2013 |

OTHER PUBLICATIONS

International Search Report for PCT/JP2016/088413 dated Feb. 21, 2017 [PCT/ISA/210].

* cited by examiner

FUEL INJECTION DEVICE

CROSS REFERENCE TO RELATED APPLICATIONS

This application is a National Stage of International Application No. PCT/JP2016/088413, filed on Dec. 22, 2016, which claims priority from Japanese Patent Application No. 2015-249699, filed on Dec. 22, 2015.

TECHNICAL FIELD

The present invention relates to a fuel injection device.

Background Art

There is a known gas turbine fuel injection device that realizes both combustion stabilization by diffusion combustion and NOx emission reduction by lean combustion. This fuel injection device includes a pilot fuel injector for performing the diffusion combustion and a main fuel injector for performing the lean combustion. In the main fuel injector, compressed air and a fuel are premixed. Therefore, the configuration of the main fuel injector greatly affects the reduction of NOx.

Patent Literature 1 discloses a fuel injection device including a pilot fuel injector for performing diffusion combustion and a main fuel injector for performing lean combustion. The main fuel injector described in Patent Literature 1 includes a premixing air passage, in which compressed air and a fuel are premixed. The compressed air is supplied to the premixing air passage from two passages that are a main outer air passage and a main inner air passage. The fuel is supplied to the premixing air passage by being injected into the main inner air passage.

CITATION LIST

Patent Literature

PTL 1: Japanese Laid-Open Patent Application Publication No. 2013-253738

SUMMARY OF INVENTION

Technical Problem

However, the main outer air passage described in the cited Patent Literature 1 is provided with an annular inlet that is open in a manner to face an air induction pipe (a diffuser), through which the compressed air is taken in. Accordingly, the compressed air directly flows into some part of the annular inlet, but does not directly flow into other part of the annular inlet, depending on the positional relationship of these parts with the diffuser. That is, differences in the dynamic pressure of the compressed air may occur among circumferential positions in the main outer air passage, and for this reason, there is a risk that differences in the flow rate of the compressed air may occur in the main outer air passage. Therefore, in the fuel injection device of the cited Patent Literature 1, there is a risk that the premixed state may vary among circumferential positions in the main outer air passage.

The present invention has been made in view of the above. An object of the present invention is to provide a fuel injection device in which variation in the premixed state among multiple positions in the main fuel injector is less likely to occur.

Solution to Problem

A fuel injection device according to one aspect of the present invention is a fuel injection device that is supplied with compressed air from a forward side in an axial direction, which is a direction of an axis of the fuel injection device. The fuel injection device includes: a pilot fuel injector positioned on the axis of the fuel injection device; and a main fuel injector disposed such that the main fuel injector encircles the pilot fuel injector. The main fuel injector includes: a main outer air passage including an inlet that is open outward in a radial direction, the main outer air passage taking in the compressed air through the inlet; a main inner air passage including an inlet that is open inward in the radial direction, the main inner air passage taking in the compressed air through the inlet; a merged air passage, in which the compressed air taken in by the main outer air passage and the compressed air taken in by the main inner air passage merge together; and a main fuel injection port configured to inject a fuel into the compressed air taken in by the main outer air passage or into the compressed air taken in by the main inner air passage.

In this configuration, each inlet through which the compressed air is taken in is open outward or inward in the radial direction. This reduces the influence of the dynamic pressure of the compressed air that flows in from a diffuser. Therefore, differences in the flow rate of the compressed air due to differences in the dynamic pressure are less likely to occur in the main outer air passage, and thereby variation in the premixed state among circumferential positions can be suppressed. It should be noted that the above-described configuration of the fuel injection device includes not only a case where the direction in which each inlet is open is exactly perpendicular to the axis of the fuel injection device, but also a case where the direction in which each inlet is open is slightly inclined relative to the direction perpendicular to the axis of the fuel injection device. Even in the latter case, the aforementioned functional advantages can be obtained.

In the above fuel injection device, the main fuel injector may be configured to further include: a main outer swirler provided at the inlet of the main outer air passage and configured to lead, inward in the radial direction, the compressed air taken in through the inlet of the main outer air passage and cause the compressed air to swirl around the axis of the fuel injection device; and a main inner swirler provided at the inlet of the main inner air passage and configured to lead, outward in the radial direction, the compressed air taken in through the inlet of the main inner air passage and cause the compressed air to swirl around the axis of the fuel injection device.

According to the above configuration, the compressed air is supplied to the merged air passage while swirling. Therefore, in a combustion chamber positioned downstream of the fuel injection device, the compressed air spreads outward in the radial direction, and thereby a large reverse-flow region can be formed, which makes efficient combustion possible.

In the above fuel injection device, the merged air passage may include a boundary wall that is positioned at a forward part of the merged air passage in the axial direction, and the boundary wall may include: an outward deflector configured to deflect the compressed air taken in by the main outer air passage, such that a velocity component of the compressed air in a rearward axial direction increases; and an inward deflector configured to deflect the compressed air taken in by the main inner air passage, such that a velocity component of the compressed air in the rearward axial direction increases.

According to this configuration, the compressed air that has been taken in is deflected in the rearward axial direction. This makes it possible to suitably supply an air-fuel premixture generated in the merged air passage to the combustion chamber positioned downstream of the fuel injection device.

In the above fuel injection device, the main fuel injection port may include an outlet positioned upstream of an axial-direction rear end portion that is a boundary portion of the boundary wall between the outward deflector and the inward deflector.

According to this configuration, through the main fuel injection port, the fuel can be assuredly injected into the compressed air taken in by the main outer air passage or into the compressed air taken in by the main inner air passage.

In the above fuel injection device, the main fuel injector may be configured to include: a merging outer circumferential surface that demarcates the merged air passage and that is positioned rearward of the main outer air passage in the axial direction adjacently to the main outer air passage; and a merging inner circumferential surface that demarcates the merged air passage and that is positioned rearward of the main inner air passage in the axial direction adjacently to the main inner air passage. An axial-direction rear end portion of the boundary wall may be positioned forward of an axial-direction front end portion of the merging outer circumferential surface in the axial direction, and may be positioned forward of an axial-direction front end portion of the merging outer circumferential surface in the axial direction.

According to this configuration, loss of the velocity component in the radial direction due to a collision against the boundary wall can be suppressed in the compressed air taken in by the main inner air passage and the compressed air taken in by the main outer air passage. Also, according to this configuration, since the height of the boundary wall is low (i.e., the length of the boundary wall in the axial direction is short), the compressed air taken in by the main inner air passage and the compressed air taken in by the main outer air passage can be caused to start merging together at the upstream side of the merged air passage. As a result, a premixing distance over which the compressed air and the fuel are mixed together in the merged air passage can be made great, which makes it possible to sufficiently mix the compressed air and the fuel together.

In the above fuel injection device, the main fuel injection port may include an outlet, and may be configured to either: inject the fuel, at a position where the outlet faces the merging outer circumferential surface, into the compressed air taken in by the main inner air passage; or inject the fuel, at a position where the outlet faces the merging inner circumferential surface, into the compressed air taken in by the main outer air passage.

According to this configuration, in the case where the fuel is injected, at the position where the outlet faces the merging outer circumferential surface, into the compressed air taken in by the main inner air passage, the fuel obtains kinetic energy from the compressed air taken in by the main inner air passage, and is thereby allowed to move toward the compressed air taken in by the main outer air passage without colliding with a wall surface or the like. As a result, the fuel is mixed with both of the above two streams of compressed air, and consequently, premixing in which the fuel spreads uniformly can be performed. It should be noted that this advantageous effect is obtained also in the case where the fuel is injected, at the position where the outlet faces the merging inner circumferential surface, into the compressed air taken in by the main outer air passage.

In the above fuel injection device, the main fuel injection port may extend in the radial direction, and an outlet of the main fuel injection port may be positioned at the outward deflector.

According to this configuration, even in a case where the fuel is injected into the compressed air taken in by the main outer air passage, the mechanism for supplying the fuel to the main fuel injection port can be disposed at a position close to the axis of the fuel injection device. This makes it possible to suppress increase in the external dimensions of the fuel injection device.

In the above fuel injection device, the main fuel injector may be spaced apart from the pilot fuel injector outward in the radial direction. The fuel injection device may include an air reservoir that is positioned between the pilot fuel injector and the main fuel injector and that temporarily stores the compressed air. The main fuel inner air passage may take in the compressed air stored in the air reservoir through the inlet that is open toward the air reservoir and that is open inward in the radial direction.

According to this configuration, the main inner air passage takes in the compressed air whose velocity has been uniformed in the air reservoir. This further reduces the influence caused by differences in the dynamic pressure of the compressed air, the influence being exerted on the premixing performed in the main fuel injector.

Advantageous Effects of Invention

According to the above fuel injection device, variation in the premixed state among multiple positions in the main fuel injector is less likely to occur.

DESCRIPTION OF EMBODIMENTS

Figure 1:
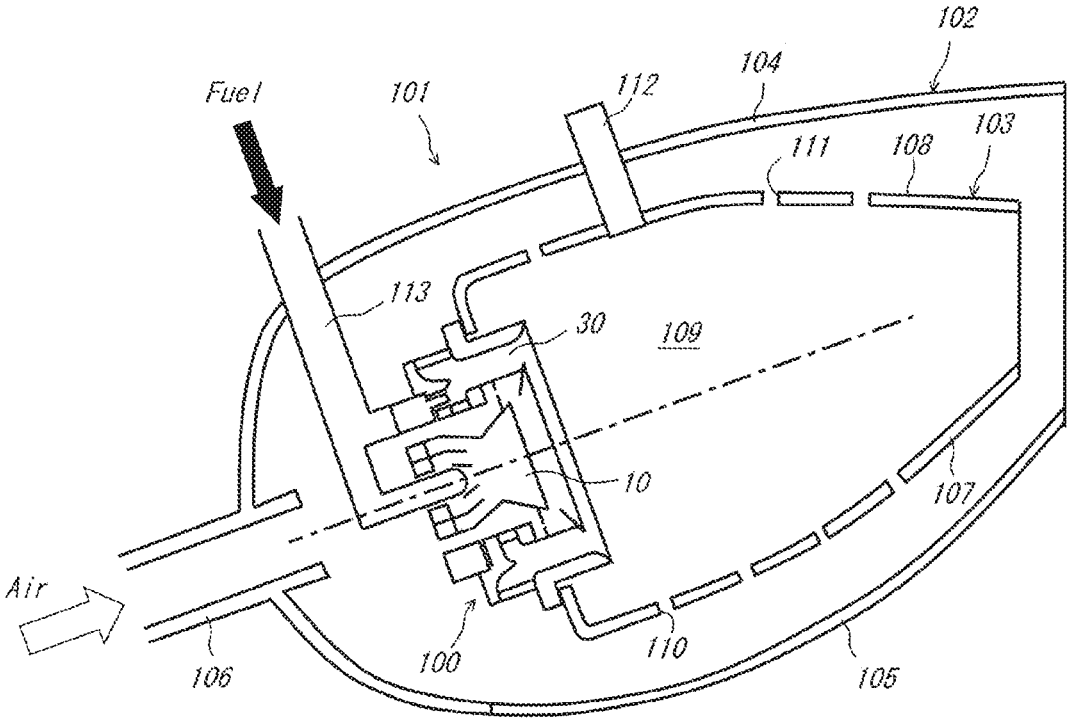
FIG. 1 is a sectional view of a combustor of Embodiment 1.

Hereinafter, embodiments of the present invention are described with reference to the drawings. In the drawings, the same or corresponding elements are denoted by the same reference signs, and repeating the same descriptions is avoided below.

Embodiment 1

First, a fuel injection device 100 according to Embodiment 1 is described.

Combustor

The fuel injection device 100 according to the present embodiment constitutes a part of a gas turbine combustor 101. First, the combustor 101 is described. The combustor 101 forms an air-fuel mixture by mixing compressed air supplied from a compressor with a fuel, and combusts the air-fuel mixture to generate a high-temperature and high-pressure combustion gas. The generated combustion gas is supplied to a turbine to drive the turbine.

Although the combustor 101 is not limited to a particular type of combustor, the combustor 101 described in the present embodiment is an annular combustor that is formed in an annular shape encircling the axis of the gas turbine. FIG. 1 is a partial cross-sectional view of the combustor 101. The right-left direction in FIG. 1 is the axial direction, i.e., the direction of the axis, of the gas turbine; the upward direction in FIG. 1 is the outward radial direction of the gas turbine; and the downward direction in FIG. 1 is the inward radial direction of the gas turbine. For the sake of convenience of the description, the left side of FIG. 1 is referred to as "front" or "forward", and the right side of FIG. 1 is referred to as "rear" or "rearward".

As shown in FIG. 1, the combustor 101 includes: an annular combustor housing 102 forming the outline of the combustor 101; an annular combustion tube 103 provided in the combustor housing 102; and a plurality of fuel injection devices 100 provided at the forward part of the combustion tube 103, such that the plurality of fuel injection devices 100 are arranged at regular intervals in the circumferential direction of the combustion tube 103.

The combustor housing 102 is formed mainly by an annular outer casing 104 and an annular inner casing 105. A diffuser 106 is formed in an annular shape at the forward part of the combustor housing 102. The diffuser 106 blows the compressed air generated by the compressor toward the fuel injection devices 100 in the combustor housing 102. It should be noted that, as an alternative, a plurality of diffusers 106 may be formed such that the plurality of diffusers 106 are arranged in the circumferential direction of the combustor housing 102. Also, struts may be disposed in the diffuser(s).

The combustion tube 103 is mainly formed by a tubular inner liner 107 and a tubular outer liner 108, and a combustion chamber 109 is formed in combustion tube 103. A plurality of air introduction ports 110 and a plurality of air introduction ports 111 are formed in the inner liner 107 and the outer liner 108, respectively. The compressed air is introduced into the combustion chamber 109 through the air introduction ports 110 and 111. A spark plug 112 is provided in a manner to penetrate the outer casing 104 and the outer liner 108. When starting the gas turbine, ignition sparks are generated in the combustion chamber 109 by the spark plug 112.

Each fuel injection device 100 includes a pilot fuel injector 10 for performing diffusion combustion and a main fuel injector 30 for performing lean combustion. A liquid fuel from a fuel pipe unit 113 is supplied to each of the pilot fuel injector 10 and the main fuel injector 30 separately. A one-dot chain line in FIG. 1 indicates the axis of the fuel injection device 100. Hereinafter, the term "axis" means the axis of the fuel injection device 100. The direction in which the axis of the fuel injection device 100 extends is referred to as "axial direction". The term "forward axial direction" or "forward in the axial direction" means the axial direction toward the upstream of the flow of the compressed air, and the term "rearward axial direction" or "rearward in the axial direction" means the axial direction toward the opposite side. The term "radial direction" means a direction orthogonal to the axial direction. Hereinafter, the pilot fuel injector 10 and the main fuel injector 30 included in the fuel injection device 100 are described in detail.

Pilot Fuel Injector

Figure 2:
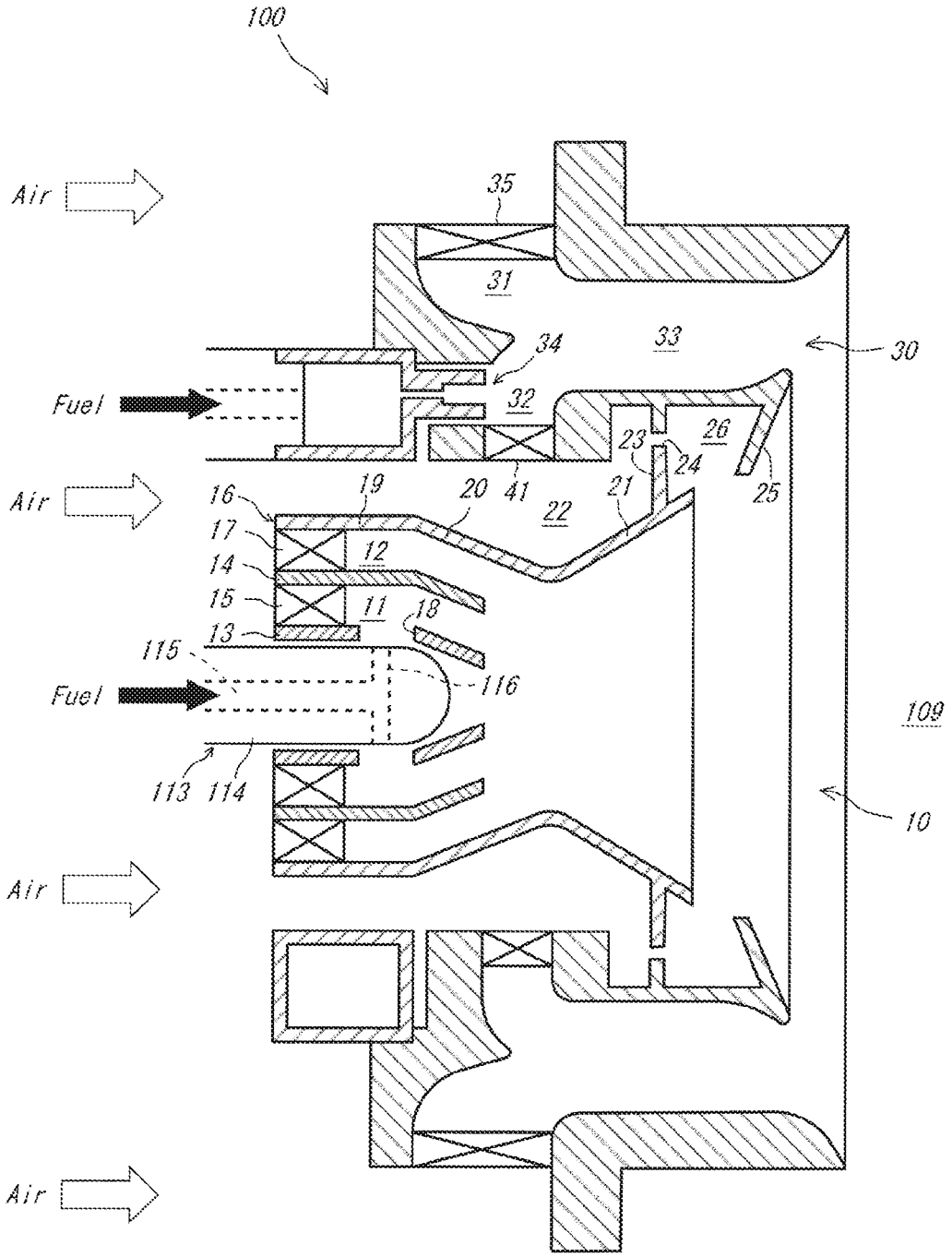
FIG. 2 is a sectional view of a fuel injection device shown in FIG. 1.

FIG. 2 is an enlarged view of the fuel injection device 100 shown in FIG. 1. The direction toward the left side of FIG. 2 is the forward axial direction, and the direction toward the right side of FIG. 2 is the rearward axial direction. The definition of these directions also applies to FIG. 3 to FIG. 5. The pilot fuel injector 10 includes an annular pilot inner air passage 11 and an annular pilot outer air passage 12. The pilot outer air passage 12 is positioned outward of the pilot inner air passage 11 in the radial direction.

The pilot inner air passage 11 is a passage for the compressed air, and is demarcated by an inner tubular body 13 and an outer tubular body 14, both of which have a tubular shape. The outer tubular body 14 is spaced apart from the inner tubular body 13 outward in the radial direction. A pilot inner swirler 15 configured to cause the compressed air to swirl around the axis is provided at the forward part of the pilot inner air passage 11 in the axial direction.

The pilot outer air passage 12 is also a passage for the compressed air, and is demarcated by the aforementioned outer tubular body 14 and a tubular pilot shroud 16. The tubular pilot shroud 16 is spaced apart from the outer tubular body 14 outward in the radial direction. A pilot outer swirler 17 configured to cause the compressed air to swirl around the axis is provided at the forward part of the pilot outer air passage 12 in the axial direction.

Fuel through-holes 18 are formed in the inner tubular body 13, such that the fuel through-holes 18 are arranged at regular intervals in the circumferential direction. Inward of the inner tubular body 13 in the radial direction, a fuel injection block 114 of the fuel pipe unit 113 is inserted. The fuel injection block 114 has a columnar shape. In the fuel injection block 114, a pilot fuel passage 115 is formed, and also, a plurality of pilot fuel injection ports 116 extending outward in the radial direction from the pilot fuel passage 115 are formed. When the fuel is supplied to the pilot fuel passage 115, the fuel is injected into the pilot inner air passage 11 through the pilot fuel injection ports 116 and the fuel through-holes 18. The fuel injected into the pilot inner air passage 11 is supplied to the combustion chamber 109 together with the compressed air passing through the pilot inner air passage 11 and the compressed air passing through the pilot outer air passage 12, and is diffusion-combusted in the combustion chamber 109.

The aforementioned pilot shroud 16 includes: a constant diameter portion 19, which is positioned at the forward part of the pilot shroud 16 in the axial direction and whose diameter is constant at any position in the axial direction; a diameter reduced portion 20, which is positioned rearward of the constant diameter portion 19 in the axial direction adjacently to the constant diameter portion 19 and whose diameter decreases rearward in the axial direction; and an expanded diameter portion 21, which is positioned rearward of the diameter reduced portion 20 in the axial direction adjacently to the diameter reduced portion 20 and whose diameter increases rearward in the axial direction. The pilot shroud 16 is provided with an annular connecting wall 23, which is positioned rearward of an air reservoir 22 (described below) in the axial direction and which couples the pilot fuel injector 10 and the main fuel injector 30 together. Air through-holes 24 are formed in the connecting wall 23 at regular intervals in the circumferential direction. Accordingly, part of the compressed air temporarily stored in the air reservoir 22 flows through the air through-holes 24 into an isolated space 26, which is formed between the connecting wall 23 and an isolating plate 25.

As mentioned above, the fuel injection device 100 according to the present embodiment includes the air reservoir 22. The air reservoir 22 is positioned between the pilot fuel injector 10 and the main fuel injector 30, and temporarily stores the compressed air that has flowed into between the pilot fuel injector 10 and the main fuel injector 30. The cross-sectional area of the air reservoir 22 is greater than that of the inlet portion of the passage demarcated by the pilot fuel injector 10 and the main fuel injector 30. Specifically, a part of the space formed between the main fuel injector 30 and the pilot fuel injector 10, the part corresponding from the diameter reduced portion 20 to the expanded diameter portion 21, serves as the air reservoir 22, and the cross-sectional area of the part is greater than the cross-sectional area of a part of the space formed between the main fuel injector 30 and the pilot fuel injector 10, the part corresponding to the constant diameter portion 19 of the pilot shroud 16.

It should be noted that, in the present embodiment, a large part of the compressed air that has flowed into between the pilot fuel injector 10 and the main fuel injector 30 flows through the air reservoir 22 into a main inner air passage 32 of the main fuel injector 30, which will be described below. Since the passage area of the main inner air passage 32 is smaller than the passage area of the air reservoir 22, the compressed air that has flowed into the air reservoir 22 is temporarily stored in the air reservoir 22. Consequently, the compressed air that has flowed into the air reservoir 22 flows into the main inner air passage 32 in a state where differences in the velocity of the compressed air among circumferential positions are reduced, i.e., in a state where the velocity of the compressed air is made uniform among the circumferential positions. Therefore, in the main inner air passage 32 of the present embodiment, differences in the flow rate of the compressed air among the circumferential positions are less likely to occur. Although the air reservoir 22 is configured as described above in the present embodiment, the configuration of the air reservoir 22 is not limited to the above example.

Main Fuel Injector

Figure 3:
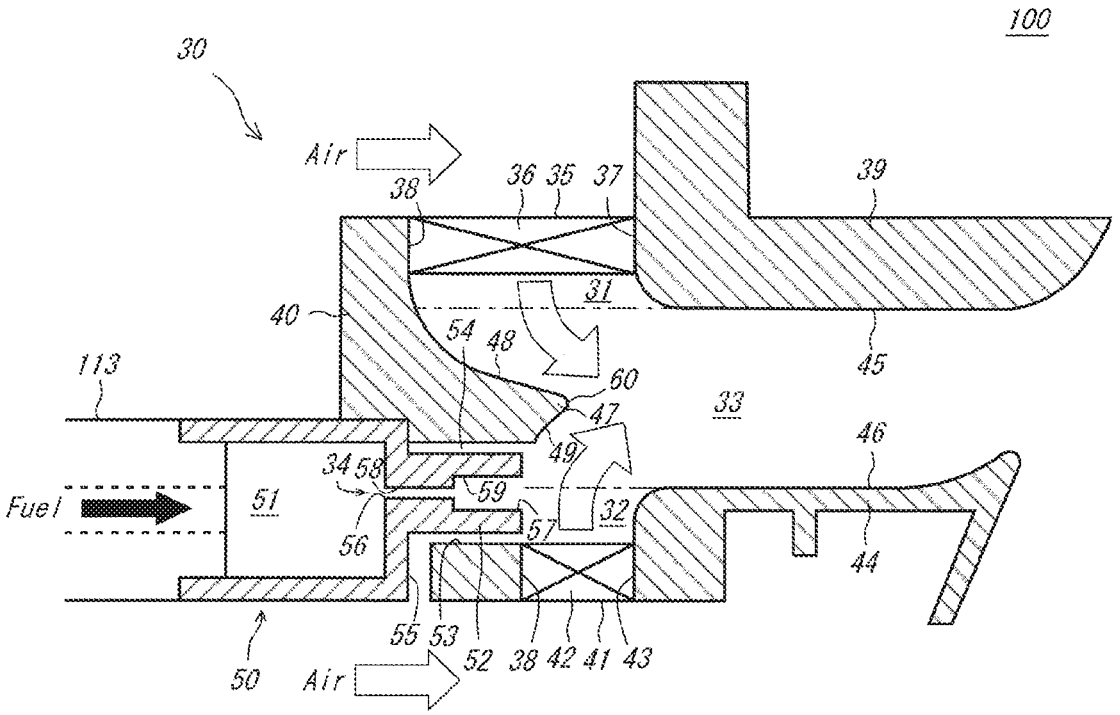
FIG. 3 is an enlarged view of a main fuel injector shown in FIG. 2.

Next, the main fuel injector 30 is described. The main fuel injector 30 is disposed such that the main fuel injector 30 is spaced apart from the pilot fuel injector 10 outward in the radial direction, and such that the main fuel injector 30 encircles the pilot fuel injector 10. FIG. 3 is an enlarged view of the main fuel injector 30 of FIG. 2, the view showing a part of the main fuel injector 30. The main fuel injector 30 includes: a main outer air passage 31 positioned outward in the radial direction; the main inner air passage 32 positioned inward in the radial direction; a merged air passage 33, in which streams of the compressed air merge together; and a main fuel injection port 34 configured to inject the fuel. It should be noted that, as described below in detail, in the present embodiment, it is assumed that a part positioned between two one-dot chain lines shown in FIG. 3 is included in the merged air passage 33.

The main outer air passage 31 includes an annular inlet 35, which is open outward in the radial direction. The main outer air passage 31 is configured to extend in the radial direction at least near the inlet 35. In the present embodiment, the entire main outer air passage 31 is configured to extend in the radial direction. The main outer air passage 31 takes in, through the inlet 35, the compressed air that flows in the rearward axial direction. That is, the main outer air passage 31 takes in the compressed air perpendicularly to the flow direction of the compressed air, and supplies the compressed air to the merged air passage 33, which is positioned inward in the radial direction. The inlet 35 of the main outer air passage 31 is provided with a main outer swirler 36 configured to lead the compressed air inward in the radial direction and cause the compressed air to swirl around the axis. In other words, a part of the main outer air passage 31, the part being provided with the main outer swirler 36, serves as the inlet 35. The main outer air passage 31 is demarcated by a main outer rear surface 37 and a main front surface 38. The main outer rear surface 37 is a surface of a tubular main outer shroud 39, the surface facing forward in the axial direction. The main front surface 38 is a surface of a main forward member 40 positioned forward of the main outer shroud 39 in the axial direction, the surface facing rearward in the axial direction.

The main inner air passage 32 includes an annular inlet 41, which is open inward in the radial direction. The main inner air passage 32 is configured to extend in the radial direction at least near the inlet 41. In the present embodiment, the entire main inner air passage 32 is configured to extend in the radial direction. The main inner air passage 32 takes in, through the inlet 41, the compressed air that flows in the rearward axial direction. That is, the main inner air passage 32 takes in the compressed air perpendicularly to the flow direction of the compressed air, and supplies the compressed air to the merged air passage 33, which is positioned outward in the radial direction. At the time, the main inner air passage 32 takes in the compressed air from the air reservoir 22 described above. To be more specific, the main inner air passage 32 takes in the compressed air stored in the air reservoir 22 through the inlet 41, which is open toward the air reservoir 22 and which is open inward in the radial direction. It should be noted that the inlet 41 of the main inner air passage 32 is provided with a main inner swirler 42 configured to lead the compressed air outward in the radial direction and cause the compressed air to swirl around the axis. In other words, a part of the main inner air passage 32, the part being provided with the main inner swirler 42, serves as the inlet 41. The main inner air passage 32 is demarcated by a main inner rear surface 43 and the main front surface 38. The main inner rear surface 43 is a surface of a tubular main inner shroud 44, the surface facing forward in the axial direction. As previously described, the main front surface 38 is a surface of the main forward member 40, the surface facing rearward in the axial direction.

The merged air passage 33 is a passage where the compressed air taken in by the main outer air passage 31 and the compressed air taken in by the main inner air passage 32 merge together. The merged air passage 33 is demarcated by a merging outer circumferential surface 45 and a merging inner circumferential surface 46. The merging outer circumferential surface 45 is a surface of the main outer shroud 39, the surface facing inward in the radial direction and being positioned rearward of the main outer air passage 31 in the axial direction adjacently to the main outer air passage 31. The merging inner circumferential surface 46 is a surface of the main inner shroud 44, the surface facing outward in the radial direction and being positioned rearward of the main inner air passage 32 in the axial direction adjacently to the main inner air passage 32.

Further, in the present embodiment, a part that is demarcated by an imaginary plane drawn by extending the merging outer circumferential surface 45 to the main forward member 40 and an imaginary plane drawn by extending the merging inner circumferential surface 46 to the main forward member 40 is also included in the merged air passage 33. That is, as previously mentioned, the part positioned between the two one-dot chain lines shown in FIG. 3 is included in the merged air passage 33. In other words, the merged air passage 33 includes: a part through which the compressed air taken in by the main outer air passage 31 and the compressed air taken in by the main inner air passage 32 flow after merging together; and a part extended from the above part in the forward axial direction. It should be noted that, in the present embodiment, the central part of the merged air passage 33 in the axial direction extends in the axial direction, and the rearward part of the merged air passage 33 in the axial direction extends radially outward relative to the axial direction.

The merged air passage 33 includes a boundary wall 47, which is positioned at the forward part of the merged air passage 33 in the axial direction. The boundary wall 47 is positioned near the center of the merged air passage 33 in the radial direction. The boundary wall 47 has a cross-sectional shape that protrudes rearward in the axial direction. The boundary wall 47 includes an outward deflector 48 and an inward deflector 49. The outward deflector 48 has a surface whose cross-sectional shape is curved. The outward deflector 48 deflects the compressed air taken in by the main outer air passage 31, such that the velocity component of the compressed air in the rearward axial direction increases. The inward deflector 49 has a surface whose cross-sectional shape is curved. The inward deflector 49 deflects the compressed air taken in by the main inner air passage 32, such that the velocity component of the compressed air in the rearward axial direction increases.

Further, in the present embodiment, an axial-direction rear end portion (distal end portion) 60, which is a boundary portion of the boundary wall 47 between the outward deflector 48 and the inward deflector 49, is positioned forward of an axial-direction front end portion of the merging outer circumferential surface 45 in the axial direction, and is positioned forward of an axial-direction front end portion of the merging inner circumferential surface 46 in the axial direction. Still further, in the present embodiment, the axial-direction rear end portion (distal end portion) 60 of the boundary wall 47 is positioned forward of the main outer rear surface 37 in the axial direction, and is positioned forward of the main inner rear surface 43 in the axial direction. As thus described, in the present embodiment, the amount of protrusion of the boundary wall 47 is small. The axial-direction rear end portion (distal end portion) 60 of the boundary wall 47 is positioned forward of an axial-direction rear end portion of the main outer swirler 36 and an axial-direction rear end portion of the main inner swirler 42 in the axial direction. However, as an alternative, the axial-direction rear end portion (distal end portion) 60 of the boundary wall 47 may be positioned rearward of the main outer rear surface 37 in the axial direction, or may be positioned rearward of the main inner rear surface 43 in the axial direction.

The main fuel injection port 34 is a fuel-injecting portion of the main fuel injector 30. Hereinafter, first, a main fuel injection block 50, in which the main fuel injection port 34 is formed, is described. The main fuel injection block 50 includes: an annular fuel passage 51, which temporarily stores therein the fuel supplied from the fuel pipe unit 113; and a plurality of injection protrusions 52, which are provided rearward of the fuel passage 51 in the axial direction, such that the plurality of injection protrusions 52 are arranged in the circumferential direction of the fuel passage 51. The main fuel injection block 50 is attached to the main forward member 40, and is attachable to and detachable from the main forward member 40 by moving the main fuel injection block 50 in the axial direction. It should be noted that the configuration of the main fuel injection block 50 is not limited to the above-described example. The main fuel injection block 50 may be eliminated. For example, the fuel passage 51 may be formed in the main forward member 40, and the fuel may be supplied from the fuel pipe unit 113 to the fuel passage 51. In this case, the fuel injection port is formed in the main forward member 40.

In the main forward member 40, a plurality of insertion holes 53 each extending in the axial direction are formed corresponding to the circumferential positions of the respective injection protrusions 52. Each of the insertion holes 53 is formed such that it is positioned inward of the distal end portion (the axial-direction rear end portion 60) of the boundary wall 47 in the radial direction. Each of the injection protrusions 52 of the main fuel injection block 50 is inserted in a corresponding one of the insertion holes 53, such that an annular gap 54 is formed. The annular gap 54 is supplied with the compressed air through an air introduction passage 55. The compressed air that has passed through the annular gap 54 jets out to form a tubular air film. As described below, the fuel is injected though the main fuel injection port 34 formed in each injection protrusion 52. Owing to the tubular air film, when the fuel injection through the main fuel injection port 34 is stopped, the fuel is purged, and thereby coking can be prevented.

The main fuel injection port 34 is formed in each injection protrusion 52 of the main fuel injection block 50. The main fuel injection port 34 extends in the axial direction, and includes: an inlet 56 positioned at an axial-direction front end portion of the main fuel injection port 34 and configured to take in the fuel from the fuel passage 51; and an outlet 57 positioned at an axial-direction rear end portion of the main fuel injection port 34 and configured to inject the fuel. Since the main fuel injection port 34 of the present embodiment is thus configured, the fuel supplied from the fuel passage 51 can be injected rearward in the axial direction. The main fuel injection port 34 further includes: a smaller diameter portion 58, which is positioned at the inlet 56 side; and a larger diameter portion 59, which is positioned at the outlet 57 side and which has a larger diameter than the smaller diameter portion 58.

The outlet 57 of the present embodiment is positioned inward of the axial-direction rear end portion 60 of the boundary wall 47 in the radial direction. Also, the outlet 57 is positioned forward of the axial-direction rear end portion 60 of the boundary wall 47 in the axial direction. To be more specific, the outlet 57 is positioned near the boundary between the main inner air passage 32 and the merged air passage 33. In other words, the outlet 57 is positioned upstream of the axial-direction rear end portion 60 of the boundary wall 47 (here, "upstream" means the upstream of the flow of the compressed air along the inward deflector 49). Accordingly, the fuel can be injected into the compressed air taken in by the main inner air passage 32. It should be noted that the position at which the outlet 57 is open is not limited to the above-described position, so long as the fuel can be injected into the compressed air taken in by the main inner air passage 32. As one example, the outlet 57 can be disposed at any suitable position in the main inner air passage 32. The outlet 57 in the present embodiment is disposed at a position where the outlet 57 faces the merging outer circumferential surface 45. That is, the outlet 57 is disposed in such manner that the merging outer circumferential surface 45 can be seen from the outlet 57. Therefore, the flow from the outlet 57 toward the merging outer circumferential surface 45 is not blocked by the boundary wall or the like.

Since the main fuel injector 30 of the present embodiment is configured as described above, the fuel injected through the main fuel injection port 34 flows together with the compressed air taken in by the main inner air passage 32, such that the fuel is conveyed toward the merging outer circumferential surface 45 while vaporizing. When the compressed air taken in by the main inner air passage 32 and the compressed air taken in by the main outer air passage 31 merge together, the flow of the compressed air becomes greatly turbulent, and thereby the fuel widely spreads. In this manner, an air-fuel premixture with a uniform fuel concentration is generated within the entire merged air passage 33. The generated air-fuel premixture is supplied to the combustion chamber 109, and lean-combusted in the combustion chamber 109. As a result, the combustion temperature is kept low, and the NOx emission can be reduced.

Further, in the present embodiment, the inlet 35 of the main outer air passage 31 and the inlet 41 of the main inner air passage 32, through which the compressed air is taken in, are open outward in the radial direction and inward in the radial direction, respectively, and the compressed air is taken in through these inlets perpendicularly to the flow direction. Therefore, differences in the flow rate of the compressed air due to differences in the dynamic pressure of the compressed air that flows in from the diffuser 106 are less likely to occur, which makes it possible to suppress variation in the premixed state among circumferential positions. In particular, the main inner air passage 32 takes in the compressed air whose velocity in the axial direction has been uniformed in the air reservoir 22. This makes it possible to further reduce the influence caused by differences in the dynamic pressure of the compressed air.

Still further, in the present embodiment, since the inlet 35 of the main outer air passage 31 and the inlet 41 of the main inner air passage 32, through which the compressed air is taken in, are open outward in the radial direction and inward in the radial direction, respectively, if the dimension of each of the inlets 35 and 41 in the axial direction is increased, a large amount of compressed air can be taken in. In this respect, for example, in a case where the inlets 35 and 41 are open forward in the axial direction, in order to take in a large amount of compressed air, it is necessary to increase the dimension of each of the inlets 35 and 41 in the radial direction. In accordance therewith, it is also necessary to increase the dimension of the entire combustor 101 in the radial direction. For these reasons, in this case, the degree of freedom in designing the combustor 101 is low. Compared to this case, the degree of freedom in designing the combustor 101 is higher in the case of adopting the fuel injection device 100 of the present embodiment.

Still further, in the present embodiment, the merged air passage 33 is provided with the boundary wall 47 including the outward deflector 48 and the inward deflector 49 so that the compressed air taken in by the fuel injection device 100 can be supplied to the combustion chamber 109, which is positioned rearward of the fuel injection device 100 in the axial direction. It should be noted that since the amount of protrusion of the boundary wall 47 in the rearward axial direction is small, the compressed air taken in by the main inner air passage 32 and the compressed air taken in by the main outer air passage 31 can be caused to start merging together at the upstream side of the merged air passage 33. As a result, a premixing distance over which the compressed air and the fuel are mixed together in the merged air passage 33 can be made great, which makes it possible to sufficiently mix the compressed air and the fuel together.

Embodiment 2

Figure 4:
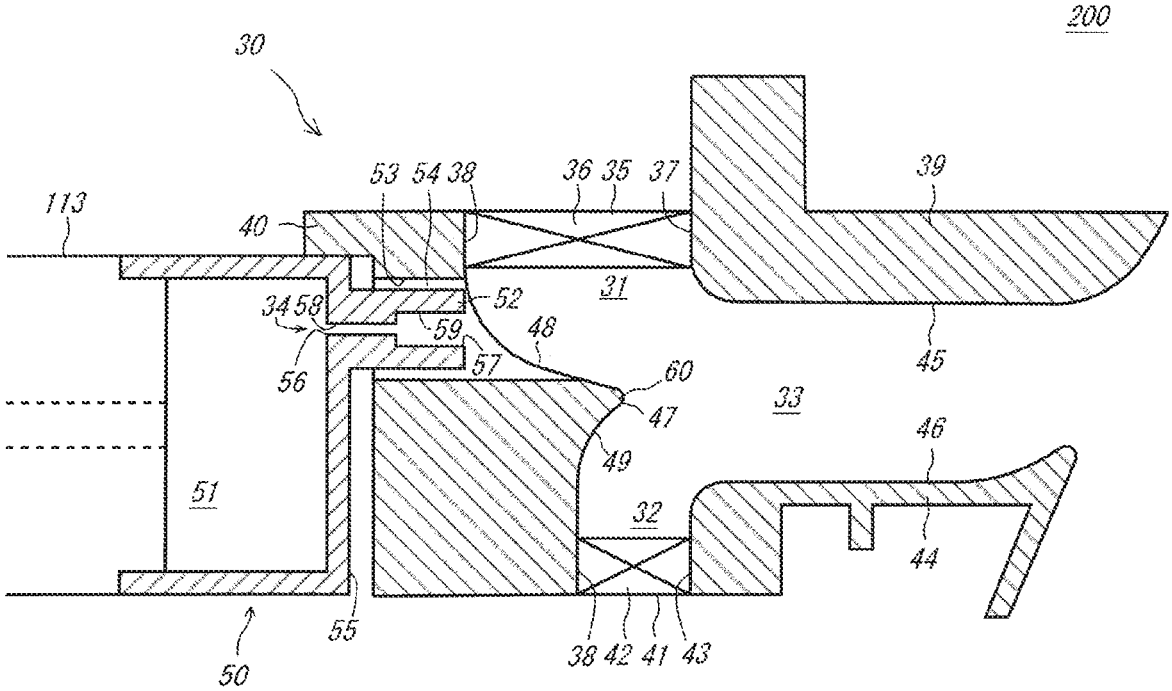
FIG. 4 is an enlarged view of a main fuel injector of Embodiment 2.

Next, a fuel injection device 200 according to Embodiment 2 is described. FIG. 4 is an enlarged view of the main fuel injector 30 in the fuel injection device 200 according to the present embodiment. As shown in FIG. 4, the fuel injection device 200 according to the present embodiment is different from the fuel injection device 100 according to Embodiment 1 in terms of the position of the main fuel injection port 34. Other than this point, the fuel injection device 200 according to the present embodiment is fundamentally the same as the fuel injection device 100 according to Embodiment 1. Hereinafter, a description is given focusing on the position of the main fuel injection port 34 of the present embodiment.

Similar to Embodiment 1, the plurality of insertion holes 53 are formed in the main forward member 40 of the present embodiment. However, in Embodiment 2, the insertion holes 53 are formed to be positioned outward of the distal end portion (the axial-direction rear end portion 60) of the boundary wall 47 in the radial direction. Each of the injection protrusions 52 of the main fuel injection block 50 is inserted in a corresponding one of the insertion holes 53. The outlet 57 of the main fuel injection port 34 is positioned outward of the axial-direction rear end portion 60 of the boundary wall 47 in the radial direction. Also, the outlet 57 is positioned forward of the axial-direction rear end portion 60 of the boundary wall 47 in the axial direction. To be more specific, the outlet 57 is open at the boundary between the main outer air passage 31 and the merged air passage 33. In other words, the outlet 57 is positioned upstream of the axial-direction rear end portion 60 of the boundary wall 47 (here, "upstream" means the upstream of the flow of the compressed air along the outward deflector 48). Accordingly, the main fuel injection port 34 of the present embodiment injects the fuel into the compressed air taken in by the main outer air passage 31. It should be noted that the outlet 57 is disposed at a position where the outlet 57 faces the merging inner circumferential surface 46.

Since the main fuel injector 30 of the present embodiment is configured as described above, the fuel injected through the main fuel injection port 34 flows together with the compressed air taken in by the main outer air passage 31, such that the fuel is conveyed toward the merging inner circumferential surface 46 while vaporizing. When the compressed air taken in by the main outer air passage 31 and the compressed air taken in by the main inner air passage 32 merge together, the flow of the compressed air becomes greatly turbulent, and thereby the fuel widely spreads. In this manner, an air-fuel premixture with an overall uniform fuel concentration is generated. Therefore, the fuel injection device 200 according to the present embodiment can provide the same functional advantages as those provided by the fuel injection device 100 according to Embodiment 1.

Embodiment 3

Figure 5:
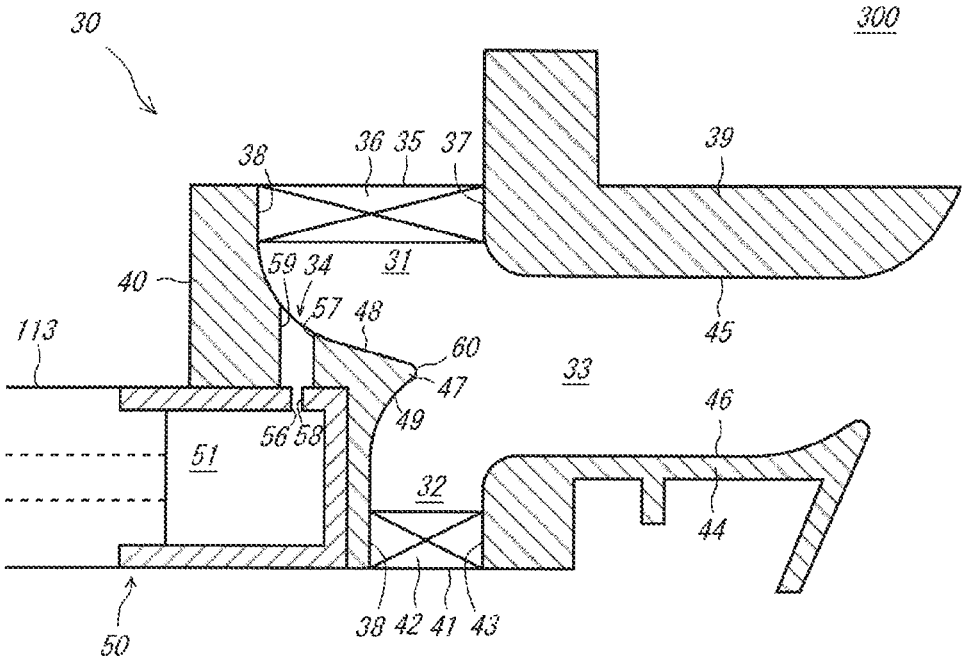
FIG. 5 is an enlarged view of a main fuel injector of Embodiment 3.

Next, a fuel injection device 300 according to Embodiment 3 is described. FIG. 5 is an enlarged view of the main fuel injector 30 in the fuel injection device 300 according to the present embodiment. As shown in FIG. 5, the fuel injection device 300 according to the present embodiment is different from the fuel injection device 100 according to Embodiment 1 in terms of the configuration of the main fuel injection port 34. Other than this point, the fuel injection device 300 according to the present embodiment is fundamentally the same as the fuel injection device 100 according to Embodiment 1. Hereinafter, a description is given focusing on the configuration of the main fuel injection port 34 of the present embodiment.

In the present embodiment, the insertion holes 53 (see FIG. 3) are not formed in the main forward member 40. Instead, the larger diameter portion 59 extending in the radial direction is formed in the main forward member 40. Although the main fuel injection block 50 does not include the injection protrusions 52 (see FIG. 3), the smaller diameter portion 58 connecting between the fuel passage 51 and the larger diameter portion 59 is formed at the radially outward part of the fuel passage 51. In this manner, in the present embodiment, the main fuel injection port 34 is formed by the larger diameter portion 59 formed in the main forward member 40 and the smaller diameter portion 58 formed in the main fuel injection block 50. The main fuel injection port 34 extends in the radial direction, and the outlet 57 thereof is positioned at the outward deflector 48.

Since the main fuel injection port 34 of the present embodiment is configured as described above, the main fuel injection port 34 injects the fuel outward in the radial direction into the compressed air taken in by the main outer air passage 31. Also in this case, the fuel injected through the main fuel injection port 34 flows together with the compressed air taken in by the main outer air passage 31, such that the fuel is conveyed toward the merging inner circumferential surface 46 while vaporizing. Then, similar to Embodiment 1, the fuel widely spreads, and an air-fuel premixture with an overall uniform fuel concentration is generated.

According to the present embodiment, even in a case where the fuel is injected into the compressed air taken in by the main outer air passage 31, since the main fuel injection port 34 extends in the radial direction, the mechanism for supplying the fuel to the main fuel injection port 34 (i.e., the main fuel injection block 50) can be disposed at a position close to the axis. This makes it possible to keep the dimension of the fuel injection device 300 in the radial direction small, and thereby the degree of freedom in designing the combustor 101 can be increased.

REFERENCE SIGNS LIST

10 pilot fuel injector
22 air reservoir
30 main fuel injector
31 main outer air passage
32 main inner air passage
33 merged air passage
34 main fuel injection port
35 inlet
41 inlet
45 merging outer circumferential surface
46 merging inner circumferential surface
47 boundary wall
48 outward deflector
49 inward deflector
57 outlet
60 axial-direction rear end portion of the boundary wall
100, 200, 300 fuel injection device

The invention claimed is:

1. A fuel injection device that is supplied with compressed air from a forward side in an axial direction, which is a direction of an axis of the fuel injection device, the fuel injection device comprising:

a pilot fuel injector positioned on the axis of the fuel injection device; and a main fuel injector disposed such that the main fuel injector encircles the pilot fuel injector, wherein the main fuel injector includes:

a main outer air passage including an inlet that is open outward in a radial direction, the main outer air passage taking in the compressed air through the inlet;

a main inner air passage including an inlet that is open inward in the radial direction, the main inner air passage taking in the compressed air through the inlet;

a merged air passage, in which the compressed air taken in by the main outer air passage and the compressed air taken in by the main inner air passage merge together; and a main fuel injection port configured to inject a fuel into the compressed air taken in by the main outer air passage or into the compressed air taken in by the main inner air passage, wherein the inlet of the main outer air passage and the inlet of the main inner air passage are annular openings, the merged air passage includes a boundary wall that is positioned at a forward part of the merged air passage in the axial direction, and the boundary wall includes:

an outward deflector configured with a curved surface to deflect the compressed air taken in by the main outer air passage toward a rearward axial direction, such that a velocity component of the compressed air in a rearward axial direction increases; and an inward deflector configured with a curved surface to deflect the compressed air taken in by the main inner air passage toward a rearward axial direction, such that a velocity component of the compressed air in the rearward axial direction increases.

2. The fuel injection device according to claim 1, wherein the main fuel injector further includes:

a main outer swirler provided at the inlet of the main outer air passage and configured to lead, inward in the radial direction, the compressed air taken in through the inlet of the main outer air passage and cause the compressed air to swirl around the axis of the fuel injection device; and a main inner swirler provided at the inlet of the main inner air passage and configured to lead, outward in the radial direction, the compressed air taken in through the inlet of the main inner air passage and cause the compressed air to swirl around the axis of the fuel injection device.

3. The fuel injection device according to claim 1, wherein the main fuel injection port includes an outlet positioned upstream of an axial-direction rear end portion that is a boundary portion of the boundary wall between the outward deflector and the inward deflector.

4. The fuel injection device according to claim 3, wherein the main fuel injector includes:

a merging outer circumferential surface that demarcates the merged air passage and that is positioned rearward of the main outer air passage in the axial direction adjacently to the main outer air passage; and a merging inner circumferential surface that demarcates the merged air passage and that is positioned rearward of the main inner air passage in the axial direction adjacently to the main inner air passage, and the axial-direction rear end portion of the boundary wall is positioned forward of an axial-direction front end portion of the merging outer circumferential surface in the axial direction, and is positioned forward of an axial-direction front end portion of the merging inner circumferential surface in the axial direction.

5. The fuel injection device according to claim 3, wherein the main fuel injection port extends in the radial direction, and the outlet of the main fuel injection port is positioned at the outward deflector.

6. The fuel injection device according to claim 1, wherein the main fuel injector includes:

a merging outer circumferential surface that demarcates the merged air passage and that is positioned rearward of the main outer air passage in the axial direction adjacently to the main outer air passage; and a merging inner circumferential surface that demarcates the merged air passage and that is positioned rearward of the main inner air passage in the axial direction adjacently to the main inner air passage, and an axial-direction rear end portion of the boundary wall is positioned forward of an axial-direction front end portion of the merging outer circumferential surface in the axial direction, and is positioned forward of an axial-direction front end portion of the merging inner circumferential surface in the axial direction.

7. The fuel injection device according to claim 6, wherein the main fuel injection port includes an outlet, and is configured to either:

inject the fuel, at a position where the outlet faces the merging outer circumferential surface, into the compressed air taken in by the main inner air passage; or inject the fuel, at a position where the outlet faces the merging inner circumferential surface, into the compressed air taken in by the main outer air passage.

8. The fuel injection device according to claim 1, wherein the main fuel injection port extends in the radial direction, and an outlet of the main fuel injection port is positioned at the outward deflector.

9. The fuel injection device according to claim 1, wherein the main fuel injector is spaced apart from the pilot fuel injector outward in the radial direction, the fuel injection device comprises an air reservoir that is positioned between the pilot fuel injector and the main fuel injector and that temporarily stores the compressed air, and the main inner air passage takes in the compressed air stored in the air reservoir through the inlet that is open toward the air reservoir and that is open inward in the radial direction.

10. The fuel injection device according to claim 1, wherein the main fuel injector receives air only from the inlets of the main inner air passage and the main outer air passage facing either radially inward or radially outward.

* * * * *